US009935400B1

(12) United States Patent
Ejiri et al.

(10) Patent No.: US 9,935,400 B1
(45) Date of Patent: Apr. 3, 2018

(54) ARC DISCHARGE PREVENTION MECHANISM OF SOCKET

(71) Applicant: SMK Corporation, Tokyo (JP)

(72) Inventors: Koichiro Ejiri, Kanagawa (JP); Haruhiko Kondo, Kanagawa (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 15/593,332

(22) Filed: May 12, 2017

(30) Foreign Application Priority Data

Sep. 29, 2016 (JP) ..... 2016-191813

(51) Int. Cl.
*H01R 13/648* (2006.01)
*H01R 13/62* (2006.01)

(52) U.S. Cl.
CPC ..... *H01R 13/6485* (2013.01); *H01R 13/6205* (2013.01)

(58) Field of Classification Search
CPC ..... H01R 13/6485; H01R 13/6205
USPC ..... 439/39
See application file for complete search history.

(56) References Cited

U.S. PATENT DOCUMENTS 5,873,737 A * 2/1999 Hashizawa ..... B60L 11/1818 439/310
6,062,886 A * 5/2000 Chen ..... H01R 13/521 200/51.09
7,329,128 B1 * 2/2008 Awad ..... H01R 13/6205 439/38
7,351,066 B2 * 4/2008 DiFonzo ..... H01R 13/6205 439/39
8,133,066 B2 * 3/2012 Beak ..... H01R 13/7031 439/188
9,300,082 B2 * 3/2016 Underwood ..... H01R 13/6205
9,385,490 B2 * 7/2016 Ando ..... H01R 13/70
9,685,742 B2 * 6/2017 Liu ..... H01R 13/713
9,711,893 B2 * 7/2017 Rohrbach ..... H01R 13/6205
2007/0072443 A1 * 3/2007 Rohrbach ..... H01R 13/6205 439/39
2010/0029110 A1 * 2/2010 Kiryu ..... H01R 13/7038 439/188
2012/0295451 A1 * 11/2012 Hyun-Jun ..... H01R 13/6205 439/39
2013/0337673 A1 * 12/2013 King ..... H01R 13/713 439/188
2015/0111398 A1 * 4/2015 Isenhour ..... H01R 13/6205 439/39
2016/0006187 A1 * 1/2016 Kim ..... H01R 13/7038 439/39
2016/0218462 A1 * 7/2016 Zhao ..... H01R 13/6205

* cited by examiner

*Primary Examiner* — Alexander Gilman

(57) ABSTRACT

An arc discharge prevention structure of a socket for preventing continuous occurrence of an arc discharge which can result in a fire, by using a configuration for deflecting an arc to avoid damage to a contact is provided. At least part of a pair of permanent magnets that forms a magnetic field for deflecting an arc in a connection/disconnection area where a plug pin and a socket contact are connected and disconnected is located in an opening surface side of a socket housing in which a plug insertion hole is opened. A magnetic body of the plug is attracted to bias the plug pin to a connection position where the plug pin is hot connected to the socket contact.

11 Claims, 4 Drawing Sheets

ARC DISCHARGE PREVENTION MECHANISM OF SOCKET

CROSS REFERENCE TO RELATED APPLICATION

The contents of the following Japanese patent application are incorporated herein by reference, Japanese Patent Application No. 2016-191813 filed on Sep. 29, 2016.

FIELD

The present invention relates to an arc discharge prevention mechanism of a socket for preventing an arc discharge occurring in the instant when a plug pin and a socket contact are hot connected or disconnected.

BACKGROUND

Socket contacts of a socket connected with terminals of a power line or the like for transmitting high-voltage high-current power may be hot connected to the plug pins of a plug to supply power to electric equipment connected with the plug. In the instant when the plug pins are connected to or disconnected from the socket contacts, high electric energy is accumulated and an arc discharge occurs between the adjoining members. Such an arc discharge can also be caused by induced electromotive force that occurs when plug pins connected with an inductive load are pulled off from the socket contacts of a socket connected with a power line.

An arc discharge can erode the plug pins of the plug and the socket contacts and accelerate degradation. Various methods have conventionally been proposed to suppress the occurrence of an arc discharge or reduce the effect thereof. For example, Patent Literature 1 discloses a method in which permanent magnets are arranged in a direction orthogonal to an opposed direction of a pair of contacts to apply a magnetic field. With this configuration, an arc is deflected by the Lorentz force to prevent damage from an arc discharge to the contacts.

CITATION LIST

Patent Literature

Patent Literature 1: Japanese Patent Application Laid-Open No. 2010-056055

SUMMARY

Technical Problem

The method discussed in Patent Literature 1 does not prevent the occurrence of an arc discharge itself, and electromagnetic noise produced by the arc discharge can adversely affect electronic circuits in the load. The method is therefore not an essential solution.

To prevent a plug connected with a socket from being easily pulled off, there is typically provided a locking mechanism. If the plug pins are inserted into plug insertion holes of the socket up to a connection position where the plug pins are hot connected to the socket contacts, the locking mechanism engages the plug with the socket. If insertion or removal force on the plug is released in an intermediate insertion position in the plug insertion holes before the plug pins reach the connection position, the plug stops at the position where the plug pins and the socket contacts adjoin each other due to a half-locked state and/or static frictional force between the plug and the socket. As a result, a state that produces an arc discharge lasts for a long time. The plug and the socket can thus be heated to cause a fire.

The present invention has been achieved in view of the foregoing conventional problems. It is therefore an object of the present invention to provide an arc discharge prevention structure of a socket for preventing the continuous occurrence of an arc discharge which results in a fire by utilizing a configuration for deflecting an arc to avoid damage to the contacts.

Solution to Problem

To achieve the foregoing object, an arc discharge prevention mechanism of a socket according to a first aspect includes: a socket housing in which a plug insertion hole that guides a plug pin of a plug in a freely insertable and removable manner is formed; a socket contact that is attached to the socket housing and hot connected to the plug pin inserted in the plug insertion hole; and a pair of permanent magnets that is arranged with a connection/disconnection area therebetween and attached to the socket housing in an orientation such that an S pole of either one of the permanent magnets is opposed to an N pole of the other, the plug pin and the socket contact being connected and disconnected in the connection/disconnection area. At least part of the pair of permanent magnets is arranged on an opening surface side of the socket housing in which the plug insertion hole is opened, and attracts a magnetic body of the plug to bias the plug pin inserted in the plug insertion hole to a connection position where the plug pin is hot connected to the socket contact.

In the connection/disconnection area where the plug pin and the socket contact are connected and disconnected, the two members lie close to each other in the direction of insertion and removal of the plug pin and an arc discharge is likely to occur therebetween. The pair of permanent magnets forms a magnetic field in a direction orthogonal to that in which the plug pin and the socket contact lie close to each other. An arc is thus deflected by the magnetic field.

In an intermediate insertion position of the plug pin where the plug pin and the socket contact lie close to each other without contact, the magnetic body of the plug is attracted by at least part of the pair of permanent magnets. The plug pin is biased to the contact position where the plug pin is hot connected to the socket contact. The plug pin therefore will not stop at the position where an arc discharge occurs.

The arc discharge prevention structure of a socket according to a second aspect is characterized in that the pair of permanent magnets each are long with a direction of insertion and removal of the plug pin as its longitudinal direction, have one end arranged on the opening surface side, and have the other end arranged beside the connection/disconnection area orthogonal to the direction of insertion and removal.

The pair of permanent magnets are long with the direction of insertion and removal of the plug pin as the longitudinal direction. The other ends are arranged beside the connection/disconnection area orthogonal to the direction of insertion and removal. In the connection/disconnection area where an arc discharge occurs, a strongest magnetic field therefore occurs in the direction orthogonal to that of the arc.

The arc discharge prevent structure of a socket according to a third aspect is characterized in that in an intermediate insertion position of the plug pin where the plug pin inserted in the plug insertion hole and the socket contact lie close to each other, attractive force for attracting the magnetic body of the plug exceeds maximum static frictional force occurring between the plug and the socket.

Since the attractive force from the magnets exceeds the static frictional force between the plug and socket in the intermediate insertion position of the plug pin where the plug pin and the socket contact lie close to each other without contact, the plug pin will not stop there.

The arc discharge prevention structure of a socket according to a fourth aspect is characterized in that the magnetic body of the plug is a permanent magnet, and a magnetic pole thereof on a side opposed to the opening surface of the socket housing is one attracting a permanent magnet on the socket side in a normal connection orientation of the plug in which the plug pin is inserted into a plug insertion hole of a corresponding socket contact.

If the plug pin is inserted into a plug insertion hole in an orientation other than the normal connection orientation, the magnetic poles of the opposed permanent magnets of the plug and the socket at the opening surface have the same polarity. Repulsive force thus occurs between the opposed permanent magnets.

According to the first aspect of the invention, an arc is deflected by the magnetic field. This prevents damage to the plug pin and the socket contact.

The pair of permanent magnets for deflecting the arc is utilized to prevent the plug pin from stopping at the intermediate insertion position where an arc discharge is likely to occur. The occurrence of a fire due to continuous occurrence of an arc discharge can thus be avoided without the provision of other configurations for that purpose.

According to the second aspect of the invention, the permanent magnets for attracting the plug pin to the connection position can generate the strongest magnetic field in the connection/disconnection area where an arc discharge occurs. This enables effective arc deflection.

According to the third aspect of the invention, the plug pin does not stop at the intermediate insertion position where the plug pin and the socket contact lie close to each other. A situation in which an arc discharge occurs continuously can thus be avoided with reliability.

According to the fourth aspect of the invention, if the plug pin is inserted into a plug insertion hole in an erroneous connection orientation, the opposed permanent magnets between the opposed plug and socket at the opening surface produce repulsive force in a direction reverse to the direction of insertion. The plug pin therefore can only be inserted into the plug insertion hole in the normal connection orientation.

DESCRIPTION OF EMBODIMENTS

Figure 1:
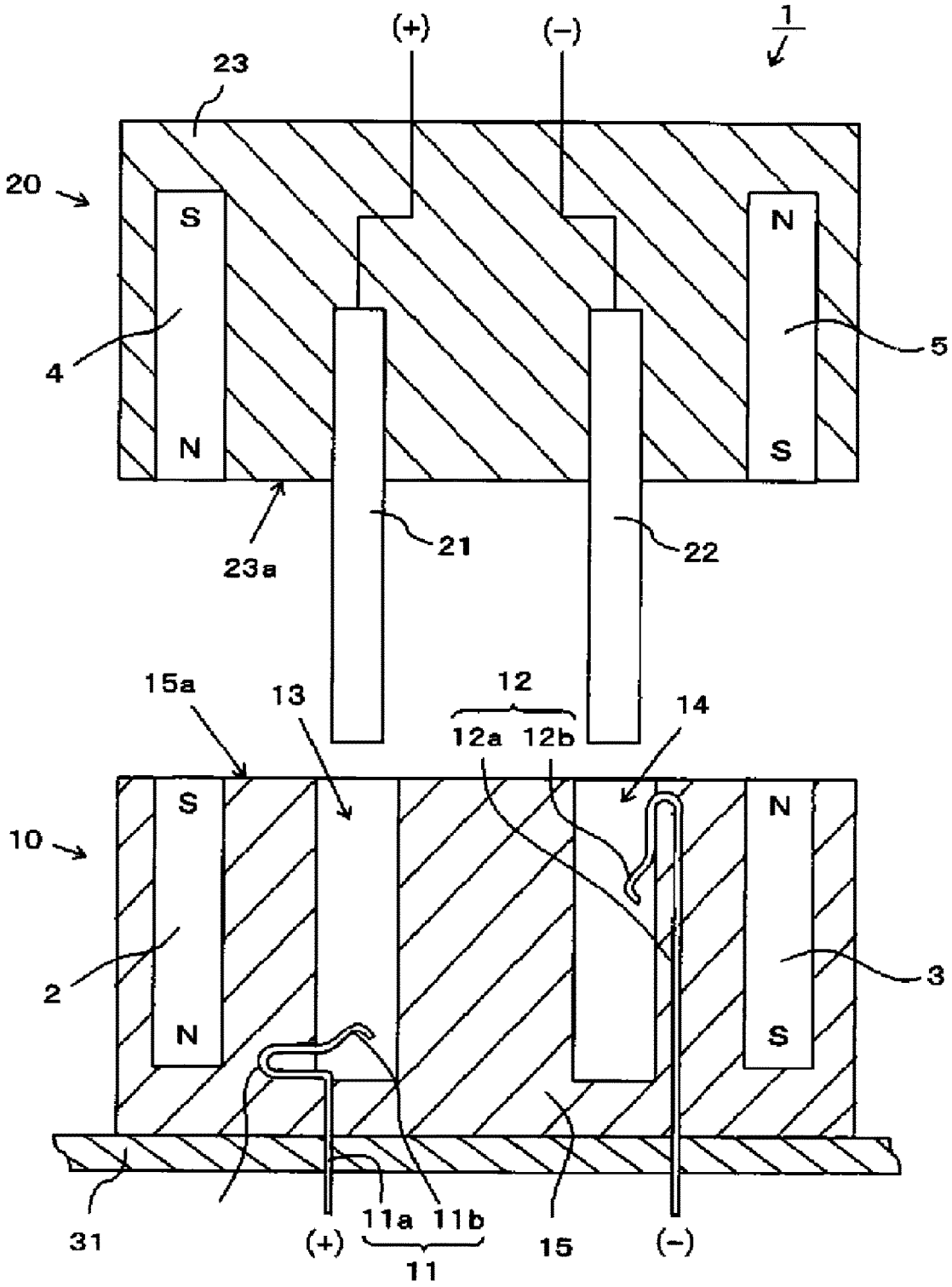
FIG. 1 is a cross-sectional view showing a socket 10 of an arc discharge prevention mechanism 1 of a socket according to an embodiment of the present invention, and a plug 20 yet to be connected to the socket 10.

An arc discharge prevention structure 1 of a socket according to an embodiment of the present invention will be described below with reference to FIGS. 1 to 4.

The arc discharge prevention structure 1 of a socket is configured so that a pair of socket contacts 11 and 12 of a socket 10 is hot connected to a corresponding pair of plug pins 21 and 22 of a plug 20. As employed herein, according to the directions shown in the drawings, a direction of insertion in which the plug 20 is inserted into plug insertion holes 13 and 14 of the socket 10 will be referred to as downward. A direction of removal in which the plug 20 is pulled off from the plug insertion holes 13 and 14 will be referred to as upward. The left and right directions shown in the drawings will be referred to as left and right directions, respectively. Various components will be described with such notation.

The socket 10 includes an insulating socket housing 15, the pair of positive- and negative-side socket contacts 11 and 12, and a pair of positive- and negative-side permanent magnets 2 and 3. A pair of positive- and negative-side plug insertion holes 13 and 14 for the pair of plug pins 21 and 22 of the plug 20 to be inserted into is formed in an upper surface 15*a* of the socket housing 15. The positive- and negative-side socket contacts 11 and 12 are attached to the socket housing 15. The positive- and negative-side permanent magnets 2 and 3 are embedded in the socket housing 15 so that their upper ends are exposed in the upper surface 15*a*.

The positive-side socket contact 11 is formed in a long narrow strip shape by pressing a metal plate of a copper alloy such as phosphor bronze and brass. The positive-side socket contact 11 includes a leg portion 11*a* and a contact portion 11*b*. The leg portion 11*a* is vertically fixed to the socket housing 15 with its lower end protruding downward from the lower surface of the socket housing 15. The contact portion 11*b* is bent in a U shape leftward from the upper end of the leg portion 11*a*. A free end of the contact portion 11*b* protrudes into a lower part at the bottom of the positive-side plug insertion hole 13. The protruding position of the contact portion 11*b* of the positive-side socket contact 11 in the positive-side plug insertion hole 13 is set to the following position. The positive-side plug pin 21 inserted into the positive-side plug insertion hole 13 and contacted with the contact portion 11*b* makes elastic contact with the positive-side socket contact 11 for a predetermined contact stroke 61 until the positive-side plug pin 21 reaches a contact position where a lower surface 23*a* of a plug housing 23 of the plug 20 and the opposed upper surface 15*a* come into contact with each other.

The negative-side socket contact 12 is also formed in a long narrow strip shape by pressing a metal plate of a copper alloy such as phosphor bronze and brass. The negative-side socket contact 12 includes a leg portion 12*a* and a contact portion 12*b*. The leg portion 12*a* is vertically fixed to the socket housing 15 along beside the negative-side plug insertion hole 14. The lower end of the leg portion 12*a* protrudes downward from the lower surface of the socket housing 15. The contact portion 12*b* is folded back in an inverted U shape at the top of the leg portion 12*a*. A free end of the contact portion 12*b* protrudes from an intermediate position on an inner side surface of the negative-side plug insertion hole 14.

The leg portion 11*a* of the positive-side socket contact 11 and the leg portion 12*a* of the negative-side socket contact 12 are soldered to a power supply pattern of a circuit substrate 31 on which the socket 10 is mounted. For example, the leg portions 11*a* and 12*a* are connected with a high voltage side and a low voltage side, respectively, of a direct-current power supply that outputs direct-current power with 48V, 2 A, and 96 W through a not-shown direct-current power line.

The pair of positive- and negative-side permanent magnets 2 and 3 have a long rod-like shape. As shown in the diagram, the positive-side permanent magnet 2 is vertically embedded in the socket housing 15 on the left of the positive-side plug insertion hole 13. The upper end portion of the positive-side permanent magnet 2 exposed in the upper surface 15*a* is an S pole. The lower end portion embedded to the left of the contact portion 11*b* is an N pole. The other negative-side permanent magnet 3 is vertically embedded in the socket housing 15 on the right of the negative-side plug insertion hole 14. The negative-side permanent magnet 3 is embedded in a position symmetrical with the positive-side permanent magnet 2 with the pair of positive- and negative-side plug insertion holes 13 and 14 therebetween. To form a horizontal magnetic field with the positive-side permanent magnet 2, the upper end portion of the negative-side permanent magnet 3 exposed in the upper surface 15*a* is configured to be an N pole. The lower end portion embedded to the depth of the contact portion 11*b* is configured to be an S pole. Consequently, there is always a magnetic field produced in a connection/disconnection area where the positive-side plug pin 21 lies close to the contact portion 11*b* of the positive-side socket contact 11. The magnetic field is produced by the magnetic lines of force from the N pole at the lower end portion of the positive-side permanent magnet 2 to the S pole at the lower end portion of the negative-side permanent magnet 3.

The plug 20 to be connected to the socket 10 includes the insulating plug housing 23, the pair of positive- and negative-side plug pins 21 and 22, and a pair of positive- and negative-side permanent magnets 4 and 5. The positive- and negative-side plug pins 21 and 22 are attached to the plug housing 23. The positive- and negative-side permanent magnets 4 and 5 are vertically embedded in the plug housing 23, with their lower ends exposed in the lower surface 23*a* of the plug housing 23.

The pair of positive- and negative-side plug pins 21 and 22 attached to the plug housing 23 is integrally fixed to the plug housing 23 to protrude downward from the lower surface 23*a* of the plug housing 23 toward the pair of positive- and negative-side plug insertion holes 13 and 14 of the socket 10, respectively. The upper ends of the positive- and negative-side plug pins 21 and 22 are connected to respective terminals of a not-shown power supply cable inside the plug housing 23. The positive-side plug pin 21 is thereby connected with a high voltage power supply terminal of electric equipment which operates on the power supply of the direct-current power line. The negative-side plug pin 22 is connected with a low voltage power supply terminal of the electric equipment.

The pair of positive- and negative-plug pins 21 and 22 protruding from the lower surface 23*a* of the plug housing 23 have the same protruding length. The protruding length is such that the distance between the lower surface 23*a* of the plug housing 23 and the upper surface 15*a* of the socket housing 15 becomes equal to the foregoing contact stroke 61 if the positive-side plug pin 21 is inserted into the corresponding positive-side plug insertion hole 13 of the socket 10 up to an insertion position where the lower end of the positive-side plug pin 21 makes contact with the contact portion 11*b* of the positive-side socket contact 11 located in the positive-side plug insertion hole 13. In the process of inserting the pair of plug pins 21 and 22 into the pair of plug insertion holes 13 and 14, the negative-side plug pin 22 thus makes sliding contact with the contact portion 12*b* of the negative-side socket contact 12. The positive-side plug pin 21 then comes into contact with the contact portion 11*b* of the positive-side socket contact 11. The plug pins 21 and 22 are further inserted by the contact stroke 61, and the positive-side plug pin 21 and the positive-side socket contact 11 are hot connected in the connection position where the lower surface 23*a* of the plug 20 makes contact with the upper surface 15*a* of the socket 10.

The pair of positive- and negative-side permanent magnets 4 and 5 is embedded so that their respective lower end portions are exposed in the lower surface 23*a* of the plug housing 23 in laterally symmetrical positions with the pair of plug pins 21 and 22 therebetween. Suppose that the pair of plug pins 21 and 22 is inserted into the corresponding pair of plug insertion holes 13 and 14. The lower end portions of the pair of permanent magnets 4 and 5 exposed in the lower surface 23*a* of the plug housing 23 here are opposed to the upper end portions of the pair of permanent magnets 2 and 3 exposed in the upper surface 15*a* of the opposed socket housing 15.

Figure 2:
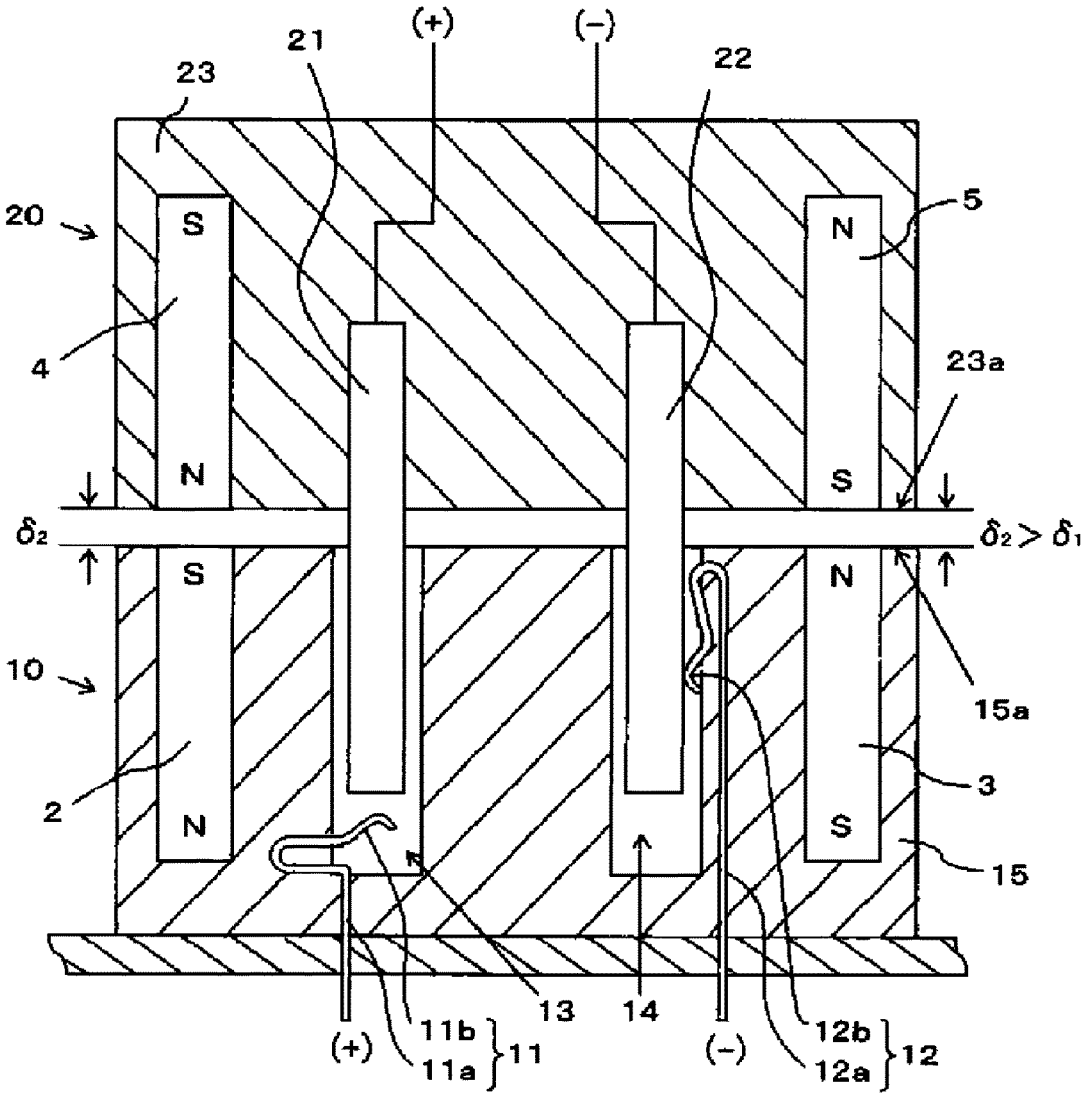
FIG. 2 is a cross-sectional view showing a state in which a positive-side plug pin 21 of the plug 20 is inserted to an intermediate insertion position where the positive-side plug pine 21 lies close to a positive-side socket contact 11 of the socket 10.
Figure 3:
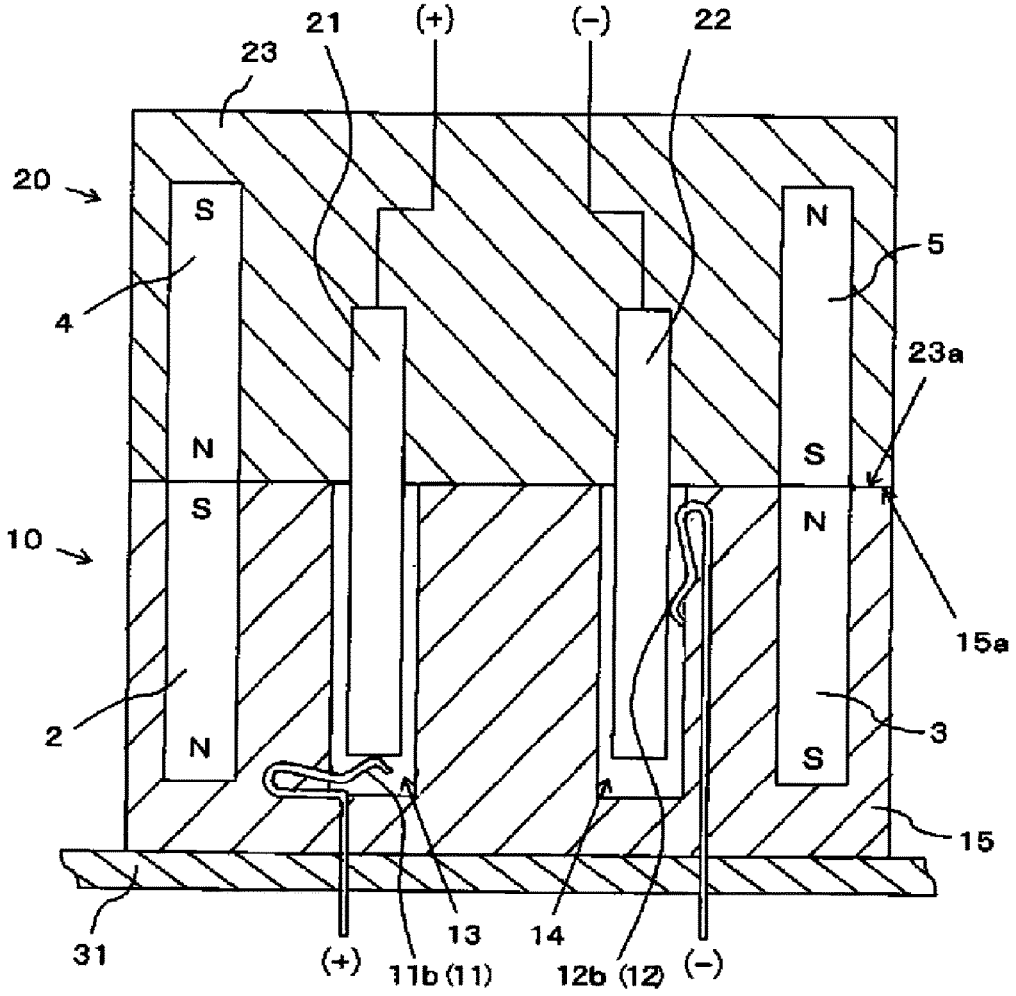
FIG. 3 is a cross-sectional view showing a state where the positive-side plug pin 21 of the plug 20 is inserted to a connection position where the positive-side plug pin 21 is hot connected to the positive-side socket contact 11 of the socket 10.

The lower end portion of the positive-side permanent magnet 4 embedded on the left of the positive-side plug pin 21 is an N pole. The lower end portion of the negative-side permanent magnet 5 embedded on the right of the negative-side plug pin 22 is an S pole. FIGS. 1 to 3 show a normal connection orientation of the plug 20, in which the positive-side plug pin 21 is inserted into the positive-side plug insertion hole 13 where the positive-side socket contact 11 is located, and the negative-side plug pin 22 is inserted into the negative-side plug insertion hole 14 where the negative-side socket contact 12 is located. In the normal connection orientation, the magnetic poles of the opposed positive-side permanent magnets 2 and 4 have opposite polarities, and the magnetic poles of the opposed negative-side permanent magnets 3 and 5 have opposite polarities. Attractive force thus acts in the direction of insertion in which the pair of plug pins 21 and 22 is inserted into the corresponding pair of plug insertion holes 13 and 14.

Figure 4:
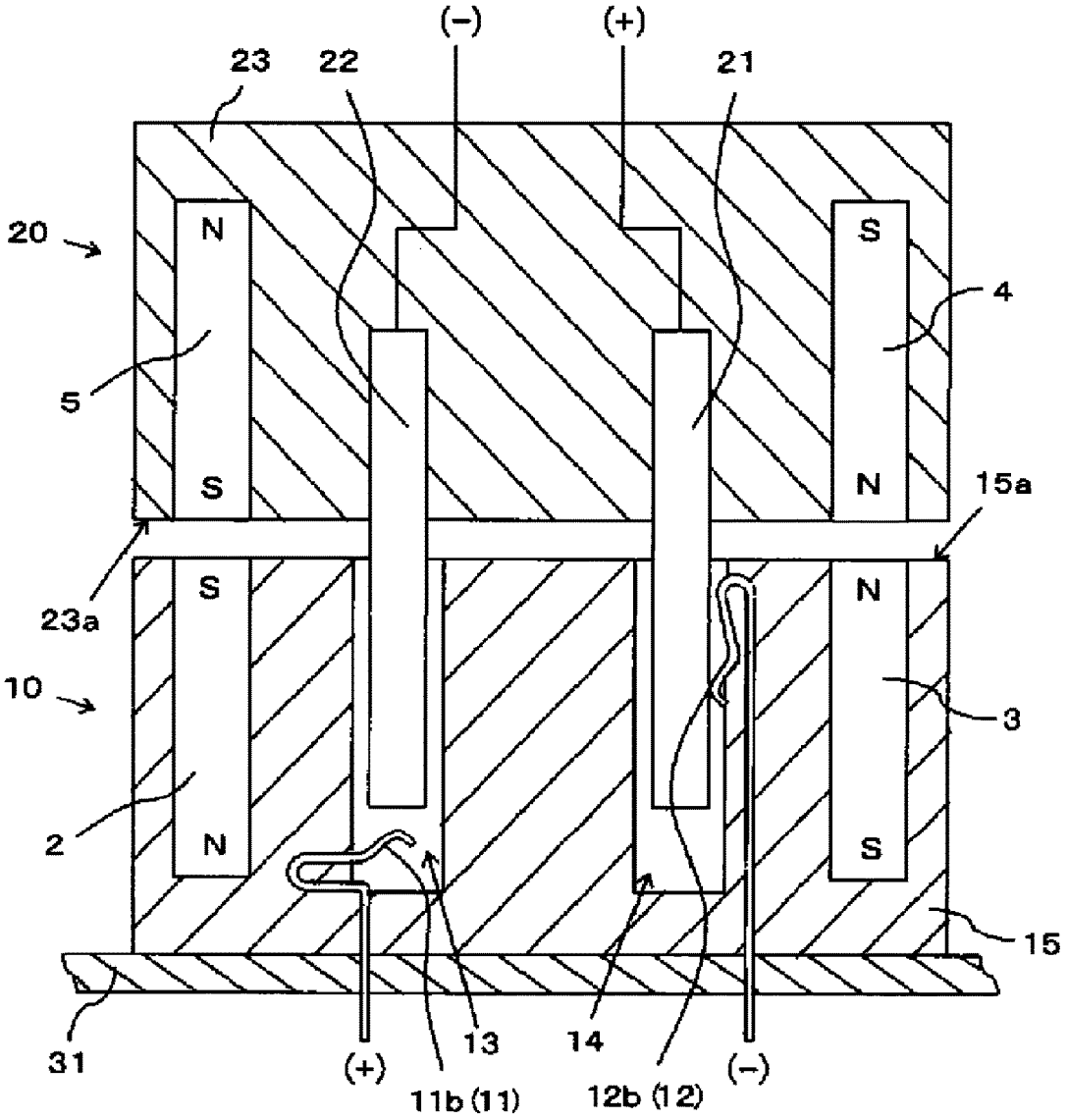
FIG. 4 is a cross-sectional view showing the plug 20 of which a pair of plug pins 21 and 22 is being inserted into a pair of plug insertion holes 13 and 14 of the socket 10 in an erroneous connection orientation.

FIG. 4 shows an erroneous connection orientation of the plug 20, in which the positive-side plug pin 21 is being inserted into the negative-side plug insertion hole 14 where the negative-side socket contact 12 is located, and the negative-side plug pin 22 is being inserted into the negative-side plug insertion hole 13 where the positive-side socket contact 11 is located. In the erroneous connection orientation, the magnetic poles of the opposed positive- and negative-side permanent magnets 2 and 5 have the same polarity. The magnetic poles of the opposed negative- and positive-side permanent magnets 3 and 4 have the same polarity. Repulsive force thus acts in the direction of removal in which the pair of plug pins 21 and 22 being inserted is expelled from the pair of plug insertion holes 13 and 14. This prevents the pair of plug pins 21 and 22 from being erroneously contacted with the socket contacts 11 and 12 of different polarities.

An operation in the process of insertion and removal for inserting and removing the plug pins 21 and 22 of the plug 20 in the normal connection orientation into/from the plug insertion holes 13 and 14 of the socket 10 will be described below. Suppose that the positive-side plug pin 21 and the negative-side plug pin 22 are inserted into the positive-side plug insertion hole 13 and the negative-side plug insertion hole 14, respectively, in the normal connection orientation of the plug 20 shown in FIG. 1. The negative-side plug pin 22 initially comes into contact with the negative-side socket contact 12 of which the contact portion 12*b* is located in the intermediate position in the negative-side plug insertion hole 14. As the negative-side plug pin 22 is inserted, the contact portion 12*b* of the negative-side socket contact 12 subsequently makes sliding contact.

FIG. 2 shows an intermediate insertion position where the plug pins 21 and 22 are inserted so that the distance between the lower surface 23*a* of the plug 20 and the upper surface 15*a* of the socket 10 becomes a distance 62 which is slightly longer than the foregoing contact stroke 61. In this position, the positive-side plug pin 21 reaches the connection/disconnection area in which the positive-side plug pin 21 lies close to the contact portion 11*b* of the positive-side socket contact 11. A potential difference between the positive-side plug pin 21 and the contact portion 11*b* of the positive-side socket contact 11 lying close to each other will be denoted by V. A current flowing through the two members across the insulation gap between the two members lying close to each other will be denoted by I. If electric energy E ($E=\int V \cdot I\, dt$) accumulated between the two members exceeds a certain boundary value, an arc discharge occurs therebetween. The boundary condition for the occurrence of the arc discharge varies with the materials, shapes, ambient environment, and insulation distance of the positive-side plug pin 21 and the contact portion 11*b*. For example, an arc discharge is considered to occur if the potential difference V exceeds 25 V and the current I exceeds 2 A.

In the present embodiment, the direct-current power supply for outputting direct-current power with 48V, 2 A, and 96 W is connected between the positive-side socket contact 11 and the negative-side socket contact 12. In the intermediate insertion position of the positive-side plug pin 21, the negative-side plug pin 22 is connected with the negative-side socket contact 12. The positive-side plug pin 21 has almost the same potential as that of the negative-side socket contact 12. The potential difference between the positive-side plug pin 21 and the positive-side socket contact 11 is therefore also considered to be 48 V. If the positive-side plug pin 21 reaches the connection/disconnection area in which the positive-side plug pin 21 lies close to the contact portion of the positive-side socket contact 11, electric energy E accumulated between the positive-side plug pin 21 and the positive-side socket contact 11 exceeds the foregoing electric energy E for causing an arc discharge, and there occurs an arc discharge.

There is a magnetic field in the connection/disconnection area where the positive-side plug pin 21 and the contact portion 11*b* of the positive-side socket contact 11 lie close to each other. The magnetic field is produced by the magnetic lines of force from the N pole at the lower end portion of the positive-side permanent magnet 2 to the S pole at the lower end portion of the negative-side permanent magnet 3. Since the magnetic field occurs in the direction orthogonal to the direction between the positive-side plug pin 21 and the contact portion 11*b* (the direction of occurrence of the arc discharge), an arc is deflected in the orthogonal direction. This reduces damage from the arc discharge to the positive-side plug pin 21 and the positive-side socket contact 11. The deflection also increases the length of the arc discharge path and thus suppresses the occurrence of the arc discharge itself.

Suppose that the distance between the lower surface 23*a* of the plug 20 and the upper surface 15*a* of the socket 10 becomes smaller than or equal to the distance δ2 shown in FIG. 2. In such a case, the magnetic attractive force between the positive-side permanent magnet 2 and the positive-side permanent magnet 4 and between the negative-side permanent magnet 3 and the negative-side permanent magnet 5 exceeds the static frictional force between the plug 20 and the socket 10. The static frictional force results from the contact between the plug housing 23 and the socket housing 15 and between the negative-side plug pin 22 and the contact portion 12*b* of the negative-side socket contact 12. Even if the insertion force on the plug 20 is removed in the intermediate insertion position shown in FIG. 2, the positive-side plug pin 21 therefore does not remain in the intermediate insertion position where an arc discharge is likely to occur. Instead, the positive-side plug pin 21 is biased to the connection position where the lower surface 23*a* of the plug 20 and the upper surface 15*a* of the socket 10 come into contact with each other.

As described above, the occurrence of an arc discharge depends on the insulation distance between the positive-side plug pin 21 and the contact portion 11*b* of the positive-side socket contact 11. The distance and the magnetic force of the permanent magnets 4 and 5 are therefore preferably adjusted so that the attractive force from the opposed permanent magnets 2 and 3 exceeds at least the static frictional force between the plug 20 and the socket 10 when the insulation distance is at the boundary value at which an arc discharge starts to occur.

Suppose that the positive-side plug pin 21 is further inserted into the positive-side plug insertion hole 13 beyond the intermediate insertion position so that the positive-side plug pin 21 makes contact with the contact portion 11*b* of the positive-side socket contact 11, and is then inserted downward by the contact stroke δ1. As shown in FIG. 3, the lower surface 23*a* of the plug 20 here makes contact with the upper surface 15*a* of the socket 10, and the positive-side plug pin 21 reaches the connection position. In the connection position, the negative-side plug pin 22 is connected with the negative-side socket contact 12. The positive-side plug pin 21 and the contact portion 11*b* of the positive-side socket contact 11 make elastic contact at a predetermined contact pressure for hot connection. As a result, the direct-current power with 48V, 2 A, and 96 W is supplied from the direct-current power supply connected with the socket 10 to the electric equipment connected with the plug 20.

To pull off the plug 20 from the socket 10, the plug 20 is pulled upward from the connection position of the positive-side plug pin 21 shown in FIG. 3. The connections between the positive-side plug pin 21 and the positive-side socket contact 11 and between the negative-side plug pin 22 and the negative-side socket contact 12 are disconnected in order reverse to the foregoing insertion order. In the process of pulling off the plug 20, the positive-side plug pin 21 enters again the connection/disconnection area where the positive-side plug pin 21 lies close to the contact portion 11*b* of the positive-side socket contact 11, and an arc discharge can occur. As with the insertion process, there is the magnetic field produced by the magnetic lines of force from the lower end portion of the positive-side permanent magnet 2 to the lower end portion of the negative-side permanent magnet 3 in the orthogonal direction. An arc is thus deflected to reduce damage from the arc discharge to the positive-side plug pin 21 and the positive-side socket contact 11. The defection may suppress the occurrence of an arc discharge itself.

If the removal force on the plug 20 is released in the intermediate insertion position of the positive-side plug pin 21, the magnetic attractive force between the positive-side permanent magnets 2 and 4 and between the negative-side permanent magnets 3 and 5 exceeds the static frictional force between the plug 20 and the socket 10. The positive-side plug pin 21 is thus moved back to the connection position where the connection portion 11*b* of the positive-side socket contact 11 makes elastic contact with the positive-side plug pin 21. This prevents the positive-side plug pin 21 from remaining in the intermediate insertion position where an arc discharge with the contact portion 11*b* of the positive-side socket contact 11 is likely to occur.

In the foregoing embodiment, the plug 20 also includes the permanent magnets 4 and 5. If the permanent magnets 2 and 3 attached to the socket 10 can attract the plug 20 in the direction of insertion, a magnetic body such as an iron plate to be magnetized by the permanent magnets 2 and 3 may be attached to the plug 20 instead.

The upper portions of the positive- and negative-side permanent magnets 2 and 3 attached to the plug 20 and the lower portions of the positive- and negative-side permanent magnets 4 and 5 attached to the socket 10 are exposed in the opposed surfaces, namely, the upper surface 15*a* of the socket housing 15 and the lower surface 23*a* of the plug housing 23. However, all or some of the permanent magnets may be covered in part with a cover or coating as long as the plug 20 and the socket 10 can be magnetically attracted to each other.

The contact portion 11*b* of the positive-side socket contact 11 is described to be configured so that the positive-side plug pin 21 comes into elastic contact from above. However, like the contact portion 12*b* of the negative-side socket contact 12, the contact portion 11*b* may have a shape to protrude into the positive-side plug insertion hole 13 from a side of the positive-side plug insertion hole 13 and make sliding contact with the positive-side plug pin 21.

The embodiment of the present invention is suitable for an arc discharge prevention structure of a socket in which a plug pin and a socket contact that may cause an arc discharge are hot connected.

REFERENCE SIGNS LIST 1 arc discharge prevention structure of socket
3 positive-side permanent magnet
3 negative-side permanent magnet
10 socket
11 positive-side socket contact
11*b* contact portion
12 negative-side socket contact
12*b* contact portion
13 positive-side plug insertion hole
14 negative-side plug insertion hole
15 socket housing
20 plug
21 positive-side plug pin
22 negative-side plug pin

The invention claimed is:

1. An arc discharge prevention mechanism of a socket comprising:

a socket housing in which a plug insertion hole that guides a plug pin of a plug in a freely insertable and removable manner is formed;

a socket contact that is attached to the socket housing and hot connected to the plug pin inserted in the plug insertion hole; and a pair of permanent magnets each having an S pole at one end and an N pole at the other end, the pair of permanent magnets being arranged to create a magnetic field across a connection/disconnection area therebetween inside the socket housing, the pair of permanent magnets having an orientation such that an S pole of one of the pair of permanent magnets is opposed to an N pole of the other, the plug pin and the socket contact being connected and disconnected in the connection/disconnection area formed inside the socket housing, wherein at least part of the pair of permanent magnets is arranged on an opening surface side of the socket housing in which the plug insertion hole is opened, and attracts a magnetic body of the plug to bias the plug pin inserted in the plug insertion hole to a connection position where the plug pin is hot connected to the socket contact, and each of the pair of permanent magnets are elongated, with a direction of insertion and removal of the plurality of plug pins in a longitudinal direction of the respective one of the pair of permanent magnets, have one end arranged on the opening surface side, and have the other end arranged beside the connection/disconnection area having a magnetic field that is orthogonal to the direction of insertion and removal.

2. The arc discharge prevention mechanism of a socket according to claim 1, wherein in an intermediate insertion position of the plug pin wherein the plug pin inserted in the plug insertion hole and the socket contact lie close to each other, an attractive force for attracting the magnetic body of the plug exceeds a maximum static frictional force occurring between the plug and the socket.

3. The arc discharge prevention mechanism of a socket according to claim 1, wherein the magnetic body of the plug is a permanent magnet; and a magnetic pole thereof on a side opposed to the opening surface of the socket housing is one attracting a permanent magnet on the socket side in a normal connection orientation of the plug in which the plug pin is inserted into a plug insertion hole of a corresponding socket contact.

4. The arc discharge prevention mechanism of a socket according to claim 1, wherein a direction of connection/disconnection of at least one of the socket contacts and the plug pin is a same as a direction of insertion and removal of the plug pin.

5. An arc discharge prevention mechanism of a socket comprising:

a socket housing in which a plurality of plug insertion holes that guide a respective plurality of plug pins of a plug in a freely insertable and removable manner are formed;

a first socket contact that is attached to the socket housing and electrically hot connected to a first of the plurality of plug pins inserted into a respective one of the plurality of plug insertion holes having a first connection position;

a second socket contact that is attached to the socket housing and electrically connected to a second of the plurality of plug pins inserted into a respective second one of the plurality of plug insertion holes having a second connection position deeper than the first connection position; and a pair of permanent magnets that is arranged with a connection/disconnection area therebetween and attached to the socket housing in an orientation such that an S pole of either one of the pair of permanent magnets is opposed to an N pole of the other, the plurality of plug pins and the socket contact being connected and disconnected in the connection/disconnection area, wherein at least part of the pair of permanent magnets is arranged on an opening surface side of the socket housing in which the plurality of plug insertion holes are opened, and attracts a magnetic body of the plug to bias the plurality of plug pins inserted in the respective plurality of plug insertion holes to first bias the first of the plurality of plug pins into electrical contact with the first socket contact in an intermediate insertion position where the first of the plurality of plug pins is electrically hot connected to the first socket contact at a first connection position while the second of the plurality of plug pins remains in an unconnected position, and thereafter further bias the second of the plurality of plug pins into a second connection position where the second of the plurality of plug pins is in electrical contact with the second socket contact.

6. The arc discharge prevention mechanism of a socket according to claim 5, wherein each of the pair of permanent magnets: are elongated, with a direction of insertion and removal of the plurality of plug pins in a longitudinal direction of the respective one of the pair of permanent magnets, have one end arranged on the opening surface side, and have the other end arranged beside the connection/disconnection area having a magnetic field that is orthogonal to the direction of insertion and removal.

7. The arc discharge prevention mechanism of a socket according to claim 5, wherein in the intermediate insertion position of the plurality of plug pins an attractive force for attracting the magnetic body of the plug exceeds a maximum static frictional force occurring between the plug and the socket.

8. The arc discharge prevention mechanism of a socket according to claim 5, wherein the magnetic body of the plug is a permanent magnet; and a magnetic pole thereof on a side opposed to the opening surface of the socket housing is one attracting a permanent magnet on the socket side in a normal connection orientation of the plug in which the plurality of plug pins are inserted into the plurality of plug insertion holes of the socket contact.

9. The arc discharge prevention mechanism of a socket according to claim 5, wherein the first socket contact is electrically connected to a ground potential.

10. The arc discharge prevention mechanism of a socket according to claim 5, wherein the plurality of plug pins all have a same protruding length.

11. The arc discharge prevention mechanism of a socket according to claim 10, wherein the pair of magnets repels connection beyond the intermediate connection position when the plug is oriented in a wrong direction with respect to the socket.

* * * * *